United States Patent [19]

Weiler et al.

[11] 4,157,144

[45] Jun. 5, 1979

[54] STERILE CLOSURE CAP

[75] Inventors: Herbert Weiler; Hans Schneider; Ludwin Weyrich, all of Marburg an der Lahn, Fed. Rep. of Germany

[73] Assignee: Behringwerke Aktiengesellschaft, Marburg an der Lahn, Fed. Rep. of Germany

[21] Appl. No.: 904,245

[22] Filed: May 9, 1978

[30] Foreign Application Priority Data

May 11, 1977 [DE] Fed. Rep. of Germany ..... 7714894

[51] Int. Cl.[2] ..... B65D 41/34

[52] U.S. Cl. ..... 215/252; 215/307; 215/329; 215/365

[58] Field of Search ..... 215/252, 329, 365, 307

[56] References Cited

U.S. PATENT DOCUMENTS

| | | | |
|---|---|---|---|
| 3,110,411 | 11/1963 | Golde | 215/329 |
| 3,329,295 | 7/1967 | Fields | 215/252 |
| 3,441,161 | 4/1969 | Van Baarn | 215/252 X |
| 3,937,348 | 2/1976 | Guala | 215/252 |

FOREIGN PATENT DOCUMENTS

| | | | |
|---|---|---|---|
| 1347895 | 11/1963 | France | 215/252 |
| 2290364 | 6/1976 | France | 215/252 |

*Primary Examiner*—Donald F. Norton

*Attorney, Agent, or Firm*—Curtis, Morris & Safford

[57] ABSTRACT

Flask which is fitted with a closure which can be sealed in such a manner as to ensure sterility of its contents and which is characterized in that it is provided at its head part with a thread, preferably a round thread which is connected with a conical ring, and in that the corresponding closure cap has an inner thread so formed as to correspond on the flask, and in which the open end of the closing cap is provided with a recess into which the tamper-proof ring is pressed in.

12 Claims, 7 Drawing Figures

STERILE CLOSURE CAP

The present invention relates to a flask which can be sealed in such a manner as to provide sterility of its contents.

The known thread closures for flasks with tamper-proof closures are prepared in general from metal. Such closures involve the risk of injuries upon opening. In order to avoid such injuries, special tools for opening are advisable. In the case of caps of plastics material, tamper-proof seals are prepared by flanging the edge, partially under the influence of heat. However, high temperatures often impair the sensitive contents of the flasks and can, therefore, be applied to a limited degree only. Other tamper-proof closures are also known, but they are big and difficult to handle so that they cannot be used for smaller flasks.

Now, we have prepared a flask which is fitted with a closure which can be sealed in such a manner as to ensure sterility of its contents and which is characterized in that it is provided at its head part with a thread, preferably a round thread which is connected with a conical ring, and in that the corresponding closure cap has an inner thread so formed as to correspond to the flask, and in which the open end of the closing cap is provided with a recess into which the tamper-proof ring is pressed in. In addition, the flask of the invention, closable under sterile conditions, is preferably characterized in that the inclination of the conical ring is between 10° and 25°, more preferably 15°, that the lower end part of the conical ring is rounded and that said rounding has a radius of 0.3 to 0.5 mm, more preferably 0.4 mm, furthermore that the tamper-proof ring has the form of a U-ring which, upon opening of the flask, is completely withdrawn from the cap, cannot be removed from the flask without being damaged and cannot be inserted again into the cap, that the tamper-proof sealing device has the form of a U-ring, the two legs of which are connected by 2 to 12, preferably 8, bridges, that the head plate of the closure cap is fitted with a pipet aspirator, that the head plate of the closure cap has the form of a bell and may be used as closing element for flasks with drop insertion part, that the flask is sealed with a rubber stopper, preferably a freeze-dry stopper, and/or the closure cap is fitted with a flat seal or conical seal, an insert disk, rubber disk or cup seal.

Figure 1:
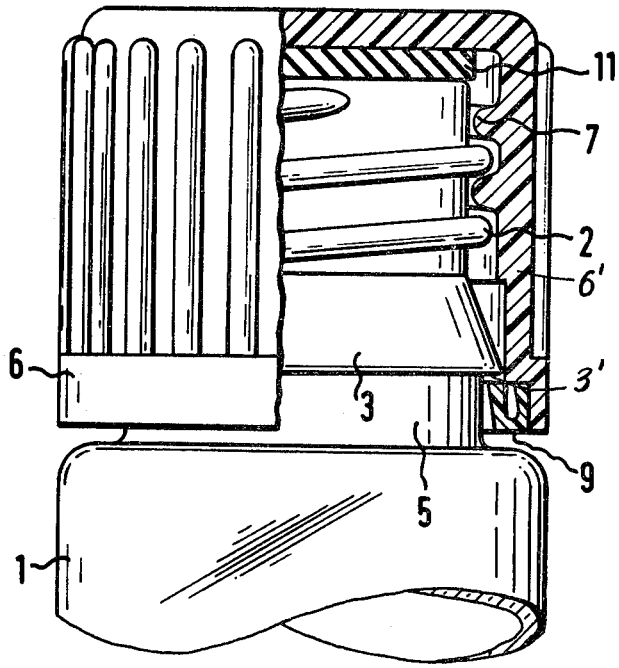
Figure 2:
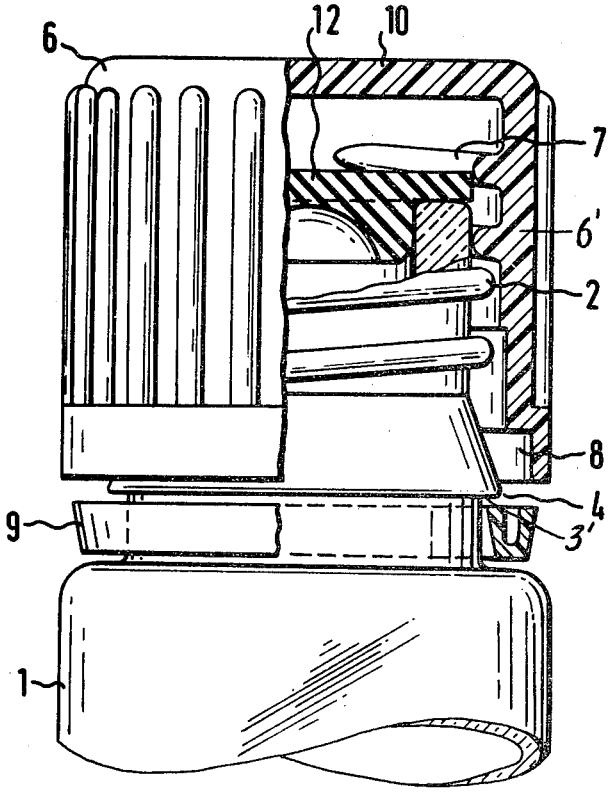

The construction of the flask and of the closure cap are illustrated in the annexed drawings. In these drawings FIG. 1 shows a screwed-on cap with closed head plate and flat sealing, FIG. 2 shows a closing cap when opened, the tamper-proof ring being already pressed out from the recess. Sealing of the flask is effected with rubber stoppers.

Figure 3:
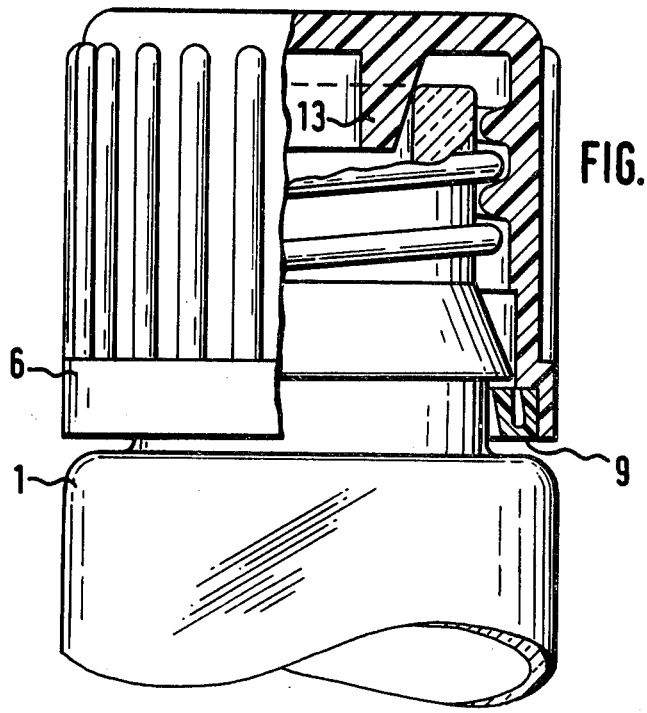

FIG. 3 shows a closing cap with conical seal, in which the tamper-proof ring has the form of a closed U-ring or as U-ring with breakable bridges.

Figure 3A:
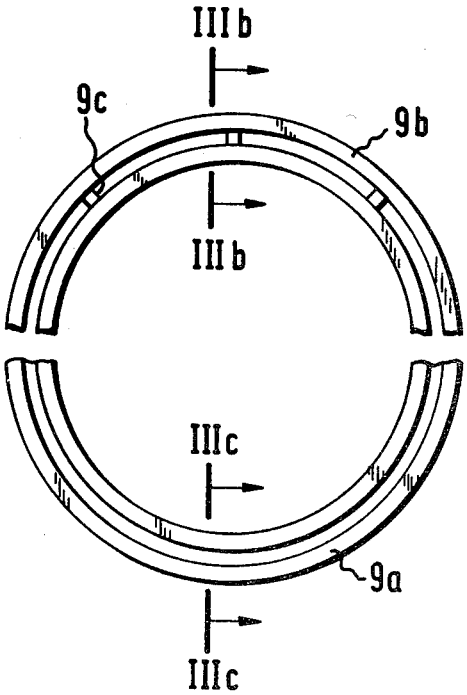

FIG. 3*a* shows a top view of the tamper-proof ring, illustrating, in the lower half, a U-ring without subdivisions and in the upper half, a U-ring both legs of which are connected over bridges.

Figure 3B:
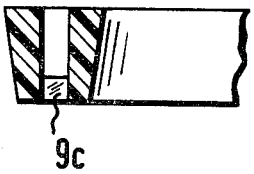

FIG. 3*b* shows a section through the U-ring, the legs of which are connected with bridges, along line III-*b*—III*b*.

Figure 3C:
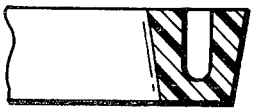

FIG. 3*c* shows a section through the U-ring without interruption along line III*c*—III*c*.

Figure 4:
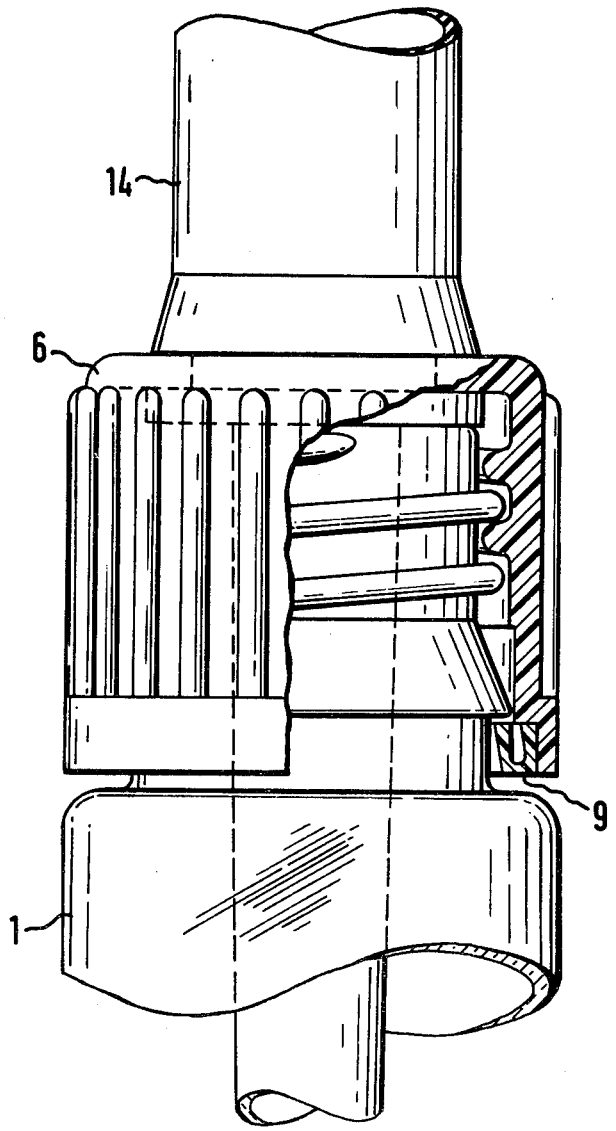

FIG. 4 shows a closing cap with pipet aspirator in mounted state.

In these drawings, the numerals have the following meanings:

(1) flask
(2) thread of the flask
(3) conical ring
(4) lower end of the conical ring
(5) neck of the flask
(6) closing cap
(7) inner thread of the closing cap
(8) recess in the closing cap for taking up the tamper-proof ring
(9) tamper-proof ring
(9*a*) closed U-ring
(9*b*) U-ring provided with bridges
(9*c*) bridges of the U-ring
(10) head plate of the closing cap
(11) flat seal
(12) rubber stopper
(13) conical seal
(14) pipet aspirator For closing the flask (1), the closing cap 6 having an internally threaded peripheral skirt 6′ is screwed onto the flask. Thereupon, the tamper-proof ring (9) catches, while sliding over the conical ring (3), under this ring as soon as it is passed over the upper end of the conical ring (3).

Upon opening of the flask, the inner leg of the tamper-proof ring (9) is pressed below the shoulder 3′ of conical ring (3) of the flask and upon further screwing off of the cap the tamper-proof ring (9) slides out from the cap and cannot be inserted again with the usual tools into the recess (8) formed in the end of the skirt of the closing cap (6). It cannot be removed from the flask without damage.

Another embodiment of the tamper-proof ring (9*b*) is a U-ring the two legs of which are connected by 2 to 10 bridges, depending on the perimeter of the closing cap. The bridges represent the tamper-proof safety devices. If the bottle is opened, the bridges are broken, the inner leg of the U-ring remains on the flask, while the outer leg is not removed from the cap. Therewith, the originality is injured.

In both cases, injury to the originality is visible.

The flask closable under sterile conditions is preferably suited for the storage of medicaments and reagents in liquid and dry form, for example in the form of powders or granules. The flask itself may be prepared from glass, plastics materials or metal.

At its head, the flask is provided with a thread (2), preferably a round thread according to German Standards, connected with a conical ring (3) the obliquity of which is between 10° and 25°, preferably 15°. The lower edge 4 of the conical ring should be rounded, since the tamper-proof ring (9) of the closing cap locks in at this place and should have a radius of from 0.2 to 0.5 mm, preferably 4 mm.

The neck of the flask (5) which is connected in right angle to the conical ring (3) must have a diameter with at least 2 mm smaller than the conical ring (3) upon it and must be at least 2 mm longer than the height of the tamper-proof ring (9) of the closing cap. Otherwise, the flask can be formed variably with regard to its height.

Thus, the body of the flask can be made in any desired form; with round flasks, however, the diameter should not be smaller than that of the cap, especially in view of industrial production.

For sealing the flask, the cap corresponding to the flask may be provided with a conical seal (13) or a flat seal (11), for example insert disks, for example a rubber disk, cup seal or similar seals. The flask may also be sealed with a rubber stopper (12), preferably a freeze-dry stopper or provided with a pipet aspirator (14).

The closing cap may be manufactured from plastics materials, preferably polyethylene, polypropylene, molding resins, or a similar material. It is provided with an internal thread fitting to the flask. At the open end, a small recess (8) which may be conical downwards or cylindrial, is provided into which the tamper-proof ring, which may be of a plastics material, is pressed in or clamped in.

If tearing-off (i.e. frangible) bridges (9*c*) are used, the tamper-proof ring may also be glued on or welded on. The tamper-proof ring may have the form of a U-ring the external leg of which, in its original state, is tapered downwards. The inclination of the conical tapering of the tamper-proof ring which, after insertion of the ring into the cap ensures a form seat and tension, is 2° to 10°.

What is claimed is:

1. A sterile closure including, in combination, a flask having a neck, including a first threaded portion and a frustroconical ring formed therein surrounding the neck below said threaded portion and defining a downwardly facing annular shoulder; and a closure cap including a peripheral skirt having an internal thread configuration which is generally complementary to the threaded portion of the container neck; said skirt including a free end having an internal annular recess formed therein and being dimensioned such that said recess is below the level of the shoulder when the cap is threaded on the neck of the flask; and an annular tamper-proof ring press-fit in said recess, said ring being generally U-shaped in cross-section and including a pair of legs, one of said legs being received in said recess and the other of said legs extending parallel thereto but inwardly of the inner surface of the skirt whereby said other leg will be located directly below said shoulder when the cap is mounted on said neck.

2. A closure as defined in claim 1 wherein said frustro-conical ring has an inclination of between 10° and 25°.

3. A closure as defined in claim 2 wherein said inclination is 15°.

4. A closure as defined in any of claims 1, 2 or 3 including a plurality of frangible bridges connecting said legs of the U-shaped ring.

5. A closure as defined in claim 4 wherein there are between 2 and 12 of said bridges.

6. A closure as defined in claim 5 wherein there are 8 of said bridges.

7. A closure as defined in any of claims 1, 2 or 3 wherein said cap includes a pipet aspirator.

8. A closure as defined in any of claims 1, 2 or 3 including means for sealing said neck.

9. A closure as defined in claim 8 wherein said sealing means comprises a rubber stopper placed in said neck.

10. A closure as defined in claim 8 wherein said sealing means comprises a flat seal positioned between said cap and the open end of said neck.

11. A closure as defined in claim 8 wherein said sealing means comprises a conically shaped sealing member projecting from said cap in position to be received in and seal said neck when the cap is threaded thereon.

12. A closure as defined in claim 1 wherein the legs of the ring are joined by an integral bight portion whereby the entire ring will be forced out of the recess when the cap is unthreaded from the neck due to the abutment of said other ring leg against said shoulder, thereby providing a visual indication of the opening of the flask.

* * * * *